United States Patent [19]

Donomoto et al.

[11] Patent Number: 4,468,272

[45] Date of Patent: Aug. 28, 1984

[54] COMPOSITE MATERIAL MANUFACTURING METHOD EXOTHERMICALLY REDUCING METALLIC OXIDE IN BINDER BY ELEMENT IN MATRIX METAL

[75] Inventors: Tadashi Donomoto; Yoshiaki Tatematsu; Atsuo Tanaka, all of Toyota, Japan

[73] Assignee: Toyota Jidosha Kabushiki Kaisha, Toyato, Japan

[21] Appl. No.: 525,945

[22] Filed: Aug. 24, 1983

[51] Int. Cl.[3] ..... B32B 31/00

[52] U.S. Cl. ..... 156/280; 156/242

[58] Field of Search ..... 156/62.2, 89, 242, 245, 156/280; 264/82, 109, 135, 259, 271.1; 29/421 R, 527.2, 527.3, 527.4

[56] References Cited

U.S. PATENT DOCUMENTS 3,550,247 12/1970 Evans et al. ..... 264/109 X 3,816,158 6/1974 Jacobs ..... 264/109 X

*Primary Examiner*—William A. Powell

*Attorney, Agent, or Firm*—Oblon, Fisher, Spivak, McClelland & Maier

[57] ABSTRACT

First a quantity of reinforcing material is formed into a shaped mass bound together by an inorganic binder. Next, this shaped mass is compounded with a quantity of a molten matrix metal by a pressure casting method. The molten matrix metal includes a quantity of a certain element with a strong tendency to become oxidized, and the inorganic binder includes a metallic oxide which, when brought into contact at high temperature with this certain element, is reduced thereby in an exothermic reaction. Thus, during the pressure casting, extra heat is produced as the certain element reduces the metallic oxide, and this aids good penetration of the matrix metal into the interstices of the reinforcing material. The metal remaining from the oxide is dispersed in the matrix metal. This metallic oxide may be silica, zirconia, chromium oxide, yttrium oxide, cerium oxide, ferric oxide, zirconium silicate, antimony oxide, or a mixture thereof; and the certain element may be lithium, calcium, magnesium, aluminum, beryllium, titanium, zirconium, or a mixture thereof.

14 Claims, 3 Drawing Figures

COMPOSITE MATERIAL MANUFACTURING METHOD EXOTHERMICALLY REDUCING METALLIC OXIDE IN BINDER BY ELEMENT IN MATRIX METAL

BACKGROUND OF THE INVENTION

The present invention relates to a method of manufacture of a composite material including reinforcing material such as fibers or whiskers or the like within a matrix of matrix metal, and more particularly relates to a method of manufacture of such a composite material utilizing a pressurized casting method in which the contact between the matrix metal and the reinforcing material is improved.

One per se well known set of methods of making composite materials of the above mentioned kind are the so called pressurized casting methods, in which the matrix metal is infiltrated into the interstices of the finely divided reinforcing material in the molten state under pressure. Such, for instance, are the high pressure casting method, the centrifugal casting method, the die casting method, the low pressure casting method, and the autoclave method. In particular, in the case of the high pressure casting method, the reinforcing material is inserted into a mold cavity of a casting mold, molten matrix metal is poured into said mold cavity onto the reinforcing material, and then pressure is applied to the matrix metal which is solidified while being kept under such pressure.

Now, in this high pressure casting method, it is a prior art concept, as proposed in Japanese Patent Application No. Sho 55-107040 (1980), for the reinforcing material to be preheated to a temperature of at least the melting point of the matrix metal, and to be maintained at that preheated temperature as the molten matrix metal is introduced into the casting mold. This preheating aids the penetration of the molten matrix metal into the interstices between the fibers, whiskers, particles, or the like of the reinforcing material, and is very helpful for producing a good quality composite material with good adhesion between the matrix metal and the reinforcing material. However, performing this preheating has the disadvantages of utilization of much energy, and also is quite troublesome with regard to handling.

Further, in this high pressure casting method, it is also a prior art concept, as proposed in Japanese Patent Application No. Sho 56-132538 (1981), for the reinforcing material to be formed into a body of a definite and quite sturdy shape in advance, before being inserted into the cavity of the casting mold. This is done in order to keep the reinforcing material fixed in a desired density, shape, and orientation during the high pressure casting process without the use of any particular special means for holding it in position in the casting mold. The concept is also well known for this forming of the reinforcing material into a formed mass in advance to be done by bonding together the fibers, whiskers, particles, or the like of the reinforcing material by the use of an inorganic binder, such as silica: a mass of the reinforcing material formed into the desired shape is steeped in an aqueous sol or the like containing the inorganic binder, and is then dried, so that the inorganic binder sticks the fibers or the like of the mass securely together. This method is very effective for ensuring that the reinforcing material is kept fixed in a desired density, shape, and orientation during the high pressure casting process; but because some of the inorganic binder remains around the fibers or the like of the reinforcing material after infiltration by the molten matrix metal, even if as described above preheating of the reinforcing material mass to a temperature equal to or higher than the melting point of the matrix metal is carried out, the contact and adhesion between the reinforcing material and the matrix metal may be deteriorated, and it is not always assured that a composite reinforced material of a high quality is produced.

SUMMARY OF THE INVENTION

Accordingly, it is the primary object of the present invention to provide a method of manufacturing of a composite material including a reinforcing material such as fibers or the like, in which before pressure casting the reinforcing material is formed into a mass of a required density, shape, and orientation, and in which very good contact and adhesion between the matrix metal and the fibers or the like of the reinforcing material are obtained, with no defect of the above type caused by the inorganic binder remaining around the reinforcing material in the produced composite material occurring, and without requiring preheating of the reinforcing material formed mass to a temperature equal to or higher than the melting point of the matrix metal, or even preheating at all of the reinforcing material formed mass.

According to the most general aspect of the present invention, the aforementioned object is accomplished by a method for making a composite material, in which: first a quantity of reinforcing material is formed into a shaped mass bound together by an inorganic binder; and then this shaped mass is compounded with a quantity of a molten matrix metal by a pressure casting method; said molten matrix metal including a quantity of a certain element with a strong tendency to become oxidized; and said inorganic binder including a metallic oxide which, when brought into contact at high temperature with said certain element, is reduced thereby in an exothermic reaction.

According to such a method, the inorganic binder causes the shaped mass of reinforcing material to be adhered together securely, so that the required density, shape, and orientation of the reinforcing fiber mass is maintained in the mold cavity during the casting process. During this casting, the certain element with a strong tendency to become oxidized reduces the metallic oxide in the inorganic binder, and produces heat by the above mentioned exothermic reaction, thus heating up to reinforcing material to a great extent, and in the best case to at least the melting point of the matrix metal. Thereby, sufficient heat for aiding with the penetration of the molten matrix metal into the interstices of the reinforcing material is made available during the pressure casting process, by this chemical means. Further, the inorganic binder which was used to form the reinforcing material into a mass before casting is also disposed of during the pressure casting process by this chemical means; in the best case, substantially completely. This means that very good contact and adhesion between the matrix metal and the fibers or the like of the reinforcing material are obtained, and defects caused by the inorganic binder remaining around the reinforcing material, in the produced composite material, do not occur. Also, preheating of the reinforcing material formed mass to a temperature equal to or higher than the melting point of the matrix metal is not required; in the best case, no preheating at all of the reinforcing material formed mass is required.

Further, according to a more particular aspect of the present invention, the aforementioned object is more particularly and concretely accomplished by such a method for making a composite material as described above, wherein said metallic oxide is one chosen from the group consisting of silica, zirconia, chromium oxide, yttrium oxide, cerium oxide, ferric oxide, zirconium silicate, antimony oxide, or is a mixture of several thereof; and further and alternatively by such a method for making a composite material as described above, wherein said certain element with a strong tendency to become oxidized is one chosen from the group consisting of lithium, calcium, magnesium, aluminum, beryllium, titanium, zirconium, or is a mixture of several thereof.

According to such a method, using such materials, the above mentioned effects have been found to be particularly efficient and beneficial.

Further, according to a yet more particular aspect of the present invention, these and other objects are more particularly and concretely accomplished by such a method for making a composite material as first described above, wherein enough of said certain element with a strong tendency to become oxidized is included within said molten matrix metal to completely reduce substantially all of said metallic oxide included in said inorganic binder.

According to such a method, the metallic oxide included in the inorganic binder will substantially all be disposed of during the casting process, and this will greatly aid with ensuring very good contact and adhesion between the matrix metal and the fibers or the like of the reinforcing material.

Further, according to a yet more particular aspect of the present invention, these and other objects are more particularly and concretely accomplished in the case that the amount of inorganic binder included within the reinforcing material shaped mass is not more than 25% by volume, and even more so in the case that the amount of inorganic binder included within the reinforcing material shaped mass is not more than 20% by volume.

The reason for this is that according to experimental researches made by the inventors of the present application it has been found that, even when the above condition relating to enough of the certain element being present in the molten matrix metal to reduce substantially all of said metallic oxide present in the inorganic binder is satisfied, if the amount of inorganic binder included within the reinforcing material shaped mass is more than 25% by volume, then it is difficult for substantially all of the metallic oxide included therein to be reduced. Further, since the cost of such an element as the certain element with a strong tendency to become oxidized is typically high, therefore if much of this element is required the manufacturing cost becomes high; and therefore this stipulation with regard to limiting the amount of the organic binder is effective for saving cost.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
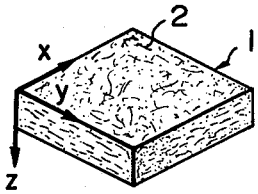
FIG. 1 is a perspective view of a rectangular body of reinforcing fibers held together by a dried inorganic binder, as used in the first embodiment of the method of the present invention.

The present invention will now be described with reference to several preferred embodiments thereof, and with reference to the appended drawings.

EMBODIMENT ONE (ALUMINA FIBERS WITH CHROMIUM OXIDE BINDER)

A mass of alumina fibers, of average fiber diameter approximately 3.2 microns, average fiber length approximately 1.5 mm, made by ICI, was dispersed in water, and the dispersion was strained through a stainless steel mesh, so that the amount of non fibrous alumina particles of diameter 150 microns or more was reduced to less than 0.1% by weight of the total. Next, the alumina fibers were drained, and steeped in a sol consisting of about 20% by weight of chromium oxide in water. Then the alumina fibers were compacted together into a block, and dried, to form a fiber body 1 as illustrated in perspective view in FIG. 1, which was held together securely by the dried chromium oxide, which functioned as an inorganic binder. The dimensions of this fiber body 1 were 80 mm by 80 mm by 20 mm. The individual alumina fibers 2 in this fiber body were oriented randomly in the x-y plane, but mostly were disposed in layers in the z direction, so that they had a so called two dimensional random orientation. The bulk density of this fiber body 1 was about 0.17 gm/cc, and the chromium oxide binder was present to the amount of approximately 15% by volume, i.e., about 24% by weight.

Figure 3:
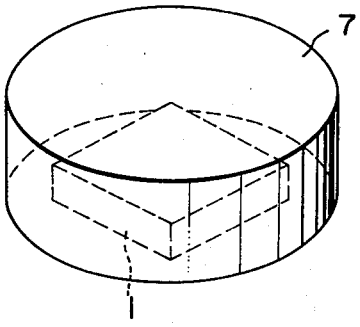
FIG. 3 is a perspective view of a cylindrical body of solidified matrix metal with the body of reinforcing fibers of FIG. 1 included in the interior thereof, as produced by the apparatus of FIG. 2 according to the first embodiment of the method of the present invention.
Figure 2:
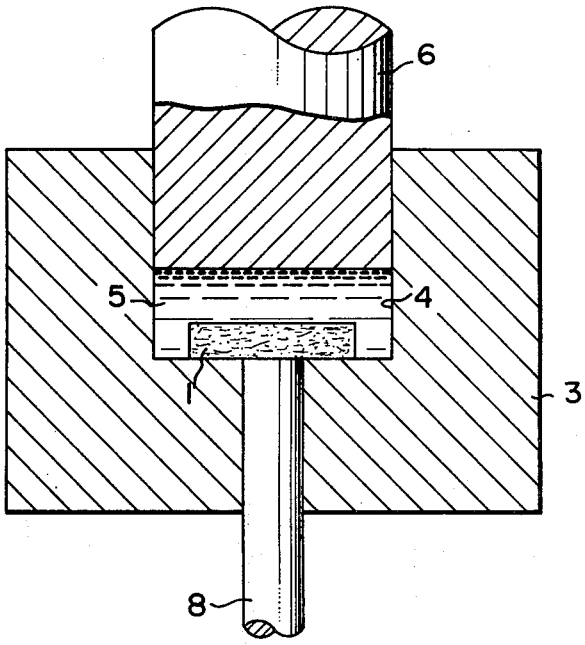
FIG. 2 is a schematic sectional view of a pressurized casting apparatus, used in the first embodiment of the method of the present invention for compounding molten matrix metal and the reinforcing fiber body shown in FIG. 1.

Next, as shown in FIG. 2, the fiber body 1, without being at all preheated, was placed within a mold cavity 4 of a casting mold 3, and then into this mold cavity 4 was poured a quantity of molten aluminum alloy 5 at approximately 720° C., which was composed of aluminum alloy of JIS standard AC8A of which the magnesium content had been increased to about 2% by weight by the addition of magnesium. The molten aluminum alloy 5 was then pressurized by a plunger 6 sliding in the mold 3 to a pressure of approximately 1000 kg/cm$^2$, and this pressure was maintained while the molten aluminum alloy 5 cooled, until it was completely solidified. Thereby, a cylindrical block 7 of composite material surrounded by aluminum alloy was manufactured, as shown in FIG. 3, about 110 mm in external diameter, and about 50 mm high. By the way, the member 8 is a knock out pin slidingly fitted in the bottom of the mold 3.

Next, from the portion of this block 7 which was made of composite material, i.e. from the portion reinforced by alumina fibers, a rotary bending test sample was cut with, taking the x direction as seen in FIG. 1 as the length direction, a length of 110 mm, a parallel portion length of 25 mm, and a parallel portion diameter of 8 mm. This test sample was rotated about its axis while applying a load in the perpendicular direction, and fatigue testing was carried out at a temperature of 250° C. by rotating, so as to find the relation between the load and the number of rotations until fracture occurred. From the S-N curve obtained from the results of this fatigue testing, the fatigue strength to resist $10^7$ rotations was predicted, and in the case of this sample it was 11 kg/mm$^2$.

For comparison, a similar piece of composite material was made in the same way as described above, except that colloidal alumina was used as the inorganic binder instead of chromium oxide. The fatigue strength to resist $10^7$ rotations of this comparison sample was only 8 kg/mm$^2$.

Next, sections of these two composite material samples, i.e. of the piece of composite material made according to the first preferred embodiment of the method of the present invention using chromium oxide binder and of the piece of comparison composite material made using colloidal alumina binder, were examined by EPMA (electron probe micro analyser), and it was observed that in the case of the piece of composite material made according to the method of the present invention using chromium oxide binder no trace of the inorganic binder remained, all of it having reacted and disappeared. On the other hand, in the case of the piece of comparison composite material made using colloidal alumina binder many traces of the inorganic binder remained around the reinforcing fibers, so that it was apparent that it had only partly reacted and disappeared. This was surmised to account for the difference, noted above, in the fatigue strengths of the two samples.

From the results of these tests, it is considered that, in the process of manufacture of this composite material according to the first preferred embodiment of the method of the present invention, the following process occurred. Since the molten matrix metal contained a relatively large amount of magnesium, which is an element with a strong tendency to become oxidized, and since the inorganic binder for the reinforcing material used was chromium oxide, which is a material which when brought into contact at high temperature with magnesium is reduced thereby in an exothermic reaction, the reduced chromium being dispersed into the molten matrix metal, when the molten aluminum alloy including the above described proportion of molten magnesium came into pressurized contact with the reinforcing fibers stuck together with chromium oxide, and by this means a satisfactory penetration of the molten aluminum alloy matrix metal between the fibers of the reinforcing material was achieved, even though the reinforcing material was not preheated before the casting process. It is surmised that at least enough heat was generated in this way to raise the temperature of the reinforcing alumina fiber material to above the melting point of the aluminum alloy matrix metal. In this way, intimate contact between the molten aluminum alloy matrix metal and the alumina fiber reinforcing material was obtained, even without the above mentioned prior art type of preheating. And, as mentioned above, no trace of chromium oxide was visible around the fibers of the resulting composite material, which suggested that substantially all the chromium oxide had been reduced to chromium, which had become dispersed in the matrix metal.

EMBODIMENT TWO (SILICON CARBIDE WHISKERS WITH FERRIC OXIDE BINDER)

A mass of silicon carbide whiskers, of average whisker diameter approximately 0.4 microns, average whisker length approximately 100 microns, made by Tokai Carbon K.K., was dispersed in water, and the dispersion was strained through a stainless steel mesh, so that the amount of non fibrous silicon carbide particles of diameter 150 microns or more was reduced to less than 5% by weight of the total. Next, the silicon carbide whiskers were drained, and steeped in a sol consisting of about 20% by weight of ferric oxide in water. Then the silicon carbide whiskers mixed with this sol were extruded and dried, so as to form a cylindrical whisker body which was held together securely by the dried ferric oxide, which functioned as an inorganic binder. The length of this cylindrical whisker body was 120 mm, and its diameter was 20 mm. The bulk density of this whisker body was about 0.5 gm/cc, and the ferric oxide binder was present to the amount of approximately 18% by volume, i.e., about 30% by weight.

Next, in a fashion similar to the practice of the first preferred embodiment of the method of the present invention as described above, the whisker body, without being preheated in any way, was placed within a mold cavity of a casting mold, and then into this mold cavity was poured a quantity of molten aluminum alloy at approximately 730° C., which was composed of aluminum alloy of JIS standard AC4C of which the magnesium content had been increased to about 0.8% by weight by the addition of magnesium. The molten aluminum alloy was then pressurized by a plunger sliding in the mold to a pressure of approximately 1000 kg/cm$^2$, and this pressure was maintained while the molten aluminum alloy cooled, until it was completely solidified. Thereby, a cylindrical block of composite material surrounded by aluminum alloy was manufactured, as in the first preferred embodiment described above.

Next, from the portion of this block which was made of composite material, i.e. from the portion reinforced by silicon carbide whiskers, a tension test sample was cut with, taking the extrusion direction as the length direction, a length of 100 mm, a parallel portion length of 30 mm, and a parallel portion diameter of 8 mm. This test sample was tested with regard to its tensile strength, and the result of this test was that a tensile strength of 45 kg/mm$^2$ was measured. When a section of this composite material sample, i.e. of the piece of composite material made according to the second preferred embodiment of the method of the present invention using ferric oxide binder, was examined by EPMA, again it was observed that no trace of the ferric oxide inorganic binder remained, all of it having reacted and disappeared.

EMBODIMENT THREE (ALUMINA FIBERS WITH SILICA BINDER)

A columnar mass of alumina fibers of fiber diameter approximately 20 microns, made by Dupont, with the fibers generally all aligned in the longitudinal direction thereof, and with a fiber volume ratio of 55%, was steeped in an aqueous silica sol (trademark "SNOW-TEX") and was dried, so as to form a cylindrical fiber body which was held together securely by the dried silica, which functioned as an inorganic binder. The length of this columnar fiber body was 120 mm, and its diameter was 20 mm.

Next, in a fashion similar to the practice of the first and second preferred embodiments of the method of the present invention as described above, the fiber body was placed within a mold cavity of a casting mold. However, in this third preferred embodiment, the fiber body was first preheated to a temperature of 800° C. Then into this mold cavity was poured a quantity of molten aluminum alloy at approximately 750° C., which was composed of approximately 4% magnesium and the remainder aluminum. The molten aluminum alloy was then pressurized by a plunger sliding in the mold to a pressure of approximately 1000 kg/cm$^2$, and this pressure was maintained while the molten aluminum alloy cooled, until it was completely solidified. Thereby, a cylindrical block of composite material surrounded by aluminum alloy was manufactured, as in the first and second preferred embodiments described above.

Next, from the portion of this block which was made of composite material, i.e. from the portion reinforced by alumina fibers, both a tension test sample and a rotary bending test sample were cut, of the same dimensions as with respect to the first and second preferred embodiments described above. These test samples were tested with regard to tensile strength and fatigue strength, again as with respect to the first and second preferred embodiments described above, and the result of these tests were that a tensile strength of 62 kg/mm$^2$ was measured, and that the fatigue strength to resist $10^7$ rotations was predicted to be 45 kg/mm$^2$.

This compares very favorably with a comparison sample made in the same way as described above, except using alumina sol as the inorganic binder instead of silica. In the case of this comparison sample, the tensile strength of 50 kg/mm$^2$ was measured, and the fatigue strength to resist $10^7$ rotations was predicted to be 30 kg/mm$^2$.

When a section of this composite material sample, i.e. of the piece of composite material made according to the third preferred embodiment of the method of the present invention using silica binder, was examined by EPMA, again it was observed that no trace of the silica inorganic binder remained, all of it having reacted and disappeared.

Although the present invention has been shown and described with reference to several preferred embodiments thereof, and in terms of the illustrative drawings, it should not be considered as limited thereby. The present invention can be applied to the case of making a composite material using as reinforcing material any types of substance. Further, the present invention can be applied to the case of making a composite material using various pressurized casting methods, such as the high pressure casting method, the centrifugal casting method, the die cast method, the low pressure casting method, or the autoclave method. Various other possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A method for making a composite material, in which:

first a quantity of reinforcing material is formed into a shaped mass bound together by an inorganic binder;

and then this shaped mass is compounded with a quantity of a molten matrix metal by a pressure casting method;

said molten matrix metal including a quantity of a certain element with a strong tendency to become oxidized;

and said inorganic binder including a metallic oxide which, when brought into contact at high temperature with said certain element, is reduced thereby in an exothermic reaction.

2. A method for making a composite material according to claim 1, wherein said metallic oxide is one chosen from the group consisting of silica, zirconia, chromium oxide, yttrium oxide, cerium oxide, ferric oxide, zirconium silicate, antimony oxide, or is a mixture of several thereof.

3. A method for making a composite material according to claim 1, wherein said certain element with a strong tendency to become oxidized is one chosen from the group consisting of lithium, calcium, magnesium, aluminum, beryllium, titanium, zirconium, or is a mixture of several thereof.

4. A method for making a composite material according to claim 1, wherein said metallic oxide is chromium oxide.

5. A method for making a composite material according to claim 4, wherein said certain element with a strong tendency to become oxidized is magnesium.

6. A method for making a composite material according to claim 5, wherein said matrix metal is aluminum alloy and said reinforcing material is alumina fibers.

7. A method for making a composite material according to claim 1, wherein said metallic oxide is ferric oxide.

8. A method for making a composite material according to claim 7, wherein said certain element with a strong tendency to become oxidized is magnesium.

9. A method for making a composite material according to claim 8, wherein said matrix metal is aluminum alloy and said reinforcing material is silicon carbide whiskers.

10. A method for making a composite material according to claim 1, wherein said metallic oxide is silica.

11. A method for making a composite material according to claim 10, wherein said certain element with a strong tendency to become oxidized is magnesium.

12. A method for making a composite material according to claim 11, wherein said matrix metal is aluminum alloy and said reinforcing material is alumina fibers.

13. A method for making a composite material according to claim 1, wherein the pressure casting method is a high pressure casting method.

14. A method for making a composite material according to claim 1, wherein enough of said certain element with a strong tendency to become oxidized is included within said molten matrix metal to completely reduce substantially all of said metallic oxide included in said inorganic binder.

* * * * *

UNITED STATES PATENT AND TRADEMARK OFFICE

CERTIFICATE OF CORRECTION

PATENT NO. : 4,468,272

DATED : August 28, 1984

INVENTOR(S) : Donomoto et al.

It is certified that error appears in the above—identified patent and that said Letters Patent is hereby corrected as shown below:

On the title page insert

--[30] Foreign Application Priority Data

JAPAN 57-176670 October 7, 1982 -- .

Signed and Sealed this

*Fourth* Day of *December 1984*

[SEAL]

*Attest:*

GERALD J. MOSSINGHOFF

*Attesting Officer*

*Commissioner of Patents and Trademarks*